US005947272A

United States Patent [19]

Park

[11] Patent Number: 5,947,272

[45] Date of Patent: Sep. 7, 1999

[54] SOAP CASE

[76] Inventor: Young-keun Park, 17/1305, Sunkyung Apt., 450, Seongsan 2-dong, Mapo-gu, Seoul, 121-252, Rep. of Korea

[21] Appl. No.: 08/841,084

[22] Filed: Apr. 29, 1997

Related U.S. Application Data

[63] Continuation-in-part of application No. 08/381,998, filed as application No. PCT/KR94/00076, Jun. 20, 1994.

[30] Foreign Application Priority Data

Jun. 21, 1993 [KR] Rep. of Korea ..... 93-11332

[51] Int. Cl.[6] ..... A47K 5/02

[52] U.S. Cl. ..... 206/77.1; D6/536; 4/628

[58] Field of Search ..... D7/500, 502, 503, D7/504, 550, 553, 566, 701; D6/529, 532, 533, 536, 538–540; D9/341; 4/628; 206/77.1; 220/574, 608, 669

[56] References Cited

U.S. PATENT DOCUMENTS

| | | | |
|---|---|---|---|
| D. 31,819 | 11/1899 | Shipman et al. | D7/566 |
| D. 124,159 | 12/1940 | Stoner | 206/77.1 X |
| D. 133,293 | 8/1942 | Anderson | D6/536 |
| D. 151,211 | 10/1948 | Bradbury | D6/540 |
| D. 202,529 | 10/1965 | Rosebrook | D9/341 |
| D. 286,354 | 10/1986 | Bussoll | D6/536 |
| D. 360,093 | 7/1995 | Bigwood | D6/536 |
| 2,175,753 | 10/1939 | Guthmann | D6/540 X |
| 2,704,907 | 3/1955 | Durkee | 206/77.1 |
| 3,219,233 | 11/1965 | Whiteford | 206/503 |
| 3,321,068 | 5/1967 | Beach | 206/306 |
| 3,343,774 | 9/1967 | Pryor | 4/628 X |
| 4,934,640 | 6/1990 | Bichon | 206/77.1 X |
| 4,993,546 | 2/1991 | Southard | 206/77.1 |
| 5,253,752 | 10/1993 | Jang | 206/77.1 |
| 5,299,683 | 4/1994 | Poole | 206/77.1 |
| 5,509,529 | 4/1996 | Kelley | 206/77.1 |

FOREIGN PATENT DOCUMENTS

| | | | |
|---|---|---|---|
| 2413116 | 10/1974 | Germany | 206/77.1 |

OTHER PUBLICATIONS

"Self Draining Soap Dish", Joan Cook, Dec. 1979, 1 sheet.

*Primary Examiner*—Jim Foster
*Attorney, Agent, or Firm*—Dvorak & Orum

[57] ABSTRACT

A soap case having a receiving portion for receiving a bar of soap, the soap case characterized in that the receiving portion has a width wider than the thickness of the bar of soap and narrower than the width of the bar of soap such that the bar of soap can be received in a standing position as a pair of relatively wider surfaces of the bar of soap face both side surfaces of the receiving portion, and a depth sufficient for the bar of soap to stably stand upright, and comprises side surfaces each being curved of which the effective contact portions actually contacting the bar of soap being received becomes narrower towards the bottom of the case, a front surface for supporting the received bar of soap to stably stand upright, a rim surface of a curved shape forming the upper portion of the side surfaces and the front surface, and a bottom surface of a curved shape sloped at a predetermined angle_downwards with respect to the receiving direction of a bar of soap, and the both side surfaces, the front surface, the rim surface and the bottom surface are curved, so that the bar of soap preferably makes point-contact with both the side surfaces, the front surface, the rim surface and the bottom surface. Thus, the water left on the surfaces of the bar of soap rapidly flows down so that the bar of soap is dries quickly, and the bar of soap does not soften and dries quickly due to the smooth ventilation of air around the bar of soap.

10 Claims, 10 Drawing Sheets

SOAP CASE

This application is a continuation-in-part of U.S. application Ser. No. 08/381,998, filed on Feb. 9, 1995, now abandoned, which is a 371 of PCT/KR94/00076, filed Jun. 20, 1994.

BACKGROUND OF THE INVENTION

The present invention relates to a soap case having a receiving portion for receiving a bar of soap in a standing position, and more particularly, to a soap case having a receiving portion for guiding the receiving of the soap voluntarily in a standing position by the load of the soap, which has a geometrical space into which a bar of a soap is received in an upright position and also a portion formed of intentional curved side surfaces and bottom surfaces having the function of making point-contact with the received soap.

In general, there are various types of soap cases and a typical conventional soap case is shown in FIG. 1. The soap case 10 has a main body 12 for receiving a bar of soap 100, which consists of a space portion 11 having a flat bottom surface and a plurality of water draining slits 12*a*. In the soap case 10, the wide surface of the soap 100 horizontally contacts the bottom surface of the main body 12 as the soap 100 is received into the soap case 10. Thus, water left wide upper surface of the soap does not drain rapidly and since there remains a large amount of water at the contact surface between the lower surface of the soap and the bottom surface of the case, the lower surface of the soap softens and disintegrates.

To solve the above problems, there have been many suggestions. However, the following fundamental problems remain unsolved.

First, a large area of the wide surface of a bar of soap continues to contact the bottom surface of a case. Second, even in the case when the bar of soap is received in a standing position, the bar of soap must be carefully placed into the soap case to make it stand upright. Third, when standing upright, the bar of soap easily falls flat due to a lack of supporting means. And fourth, there is a burden placed on the user to place the bar of soap in a particular position since there is no function of guiding the soap to voluntarily stand upright in the soap case when the soap is not put into the soap case in an upright position.

FIG. 2 illustrates an example of a soap case according to the conventional technology. In FIG. 2, the soap case 21 includes a receiving portion 22 in which a bar of soap having a predetermined length Wa, width Wb and thickness Ta is received. The receiving portion 22 has a width which is greater than the thickness Ta and narrower than width Wb of the bar of soap 200. The bottom of the receiving portion 22 is angled with respect to the base of the case 21 and the side walls of the receiving portion 22 has a depth sufficient to receive and support the bar of soap 200 in an upright position as the wide surface 201 of the soap 200 is directed to the side wall. As a result, the received bar of soap 200 remains stably in an upright position and narrow side surfaces 202 thereof is at a predetermined angle. Thus, since water left at the narrow side surfaces 202 and the wide surfaces 201 can drain rapidly, the bar of soap 200 dries quickly.

However, in such a case, since the received bar of soap 200 contacts the side surfaces or the bottom surface 22 of the case 21 partially making a surface or line contact, the bar of soap 200 still softens partially. Also, when placing the bar of soap 200 into the case 21 without care, the bar of soap may get caught on the upper edge or at the bottom corner of the side surface of the receiving portion 22. That is, there is a need to guide the bar of soap 200 to be received voluntarily and to stand voluntarily in an upright position.

SUMMARY OF THE INVENTION

To overcome the above problems, it is an object of the present invention to provide a soap case for facilitating the receiving of a bar of soap while guiding the bar of soap in a voluntary standing position, allowing the bar of soap to dry quickly and further preventing the bar of soap from softening and disintegrating away, by receiving the bar of soap in a standing position so that water on wide and narrow side surfaces of the bar of soap can drain quickly, providing a means for guiding the bar of soap to voluntarily stand or to be voluntarily received into the soap case and a means for supporting the received bar of soap to maintain standing, allowing the received bar of soap to make point-contact at a side surface or a bottom surface of a receiving portion of the soap case, and preventing water from being left between the bar of soap and the side surface or the bottom surface of the receiving portion.

Accordingly, to achieve the above object, there is provided a soap case having a receiving portion for receiving a bar of soap. The receiving portion has a width wider than the thickness of the bar of soap and narrower than the width of the bar of soap such that the bar of soap can be received in a standing position as a pair of relatively wider surfaces of the bar of soap face both side surfaces of the receiving portion, and also has a depth sufficient for the bar of soap to stably stand upright. The receiving portion includes side surfaces each being curved of which the effective contact portions actually contacting the bar of soap being received become narrower towards the bottom of the case, a front surface for supporting the received bar of soap to stably stand upright, a rim surface of a curved shape forming the upper portion of the side surfaces and the front surface, and a bottom surface of a curved shape sloped at a predetermined angle with respect to the receiving direction of a bar of soap. The both side surfaces, the front surface, the rim surface and the bottom surface are curved so that the bar of soap preferably makes point-contact with the side surfaces, the front surface, the rim surface and the bottom surface.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

Figure 1:
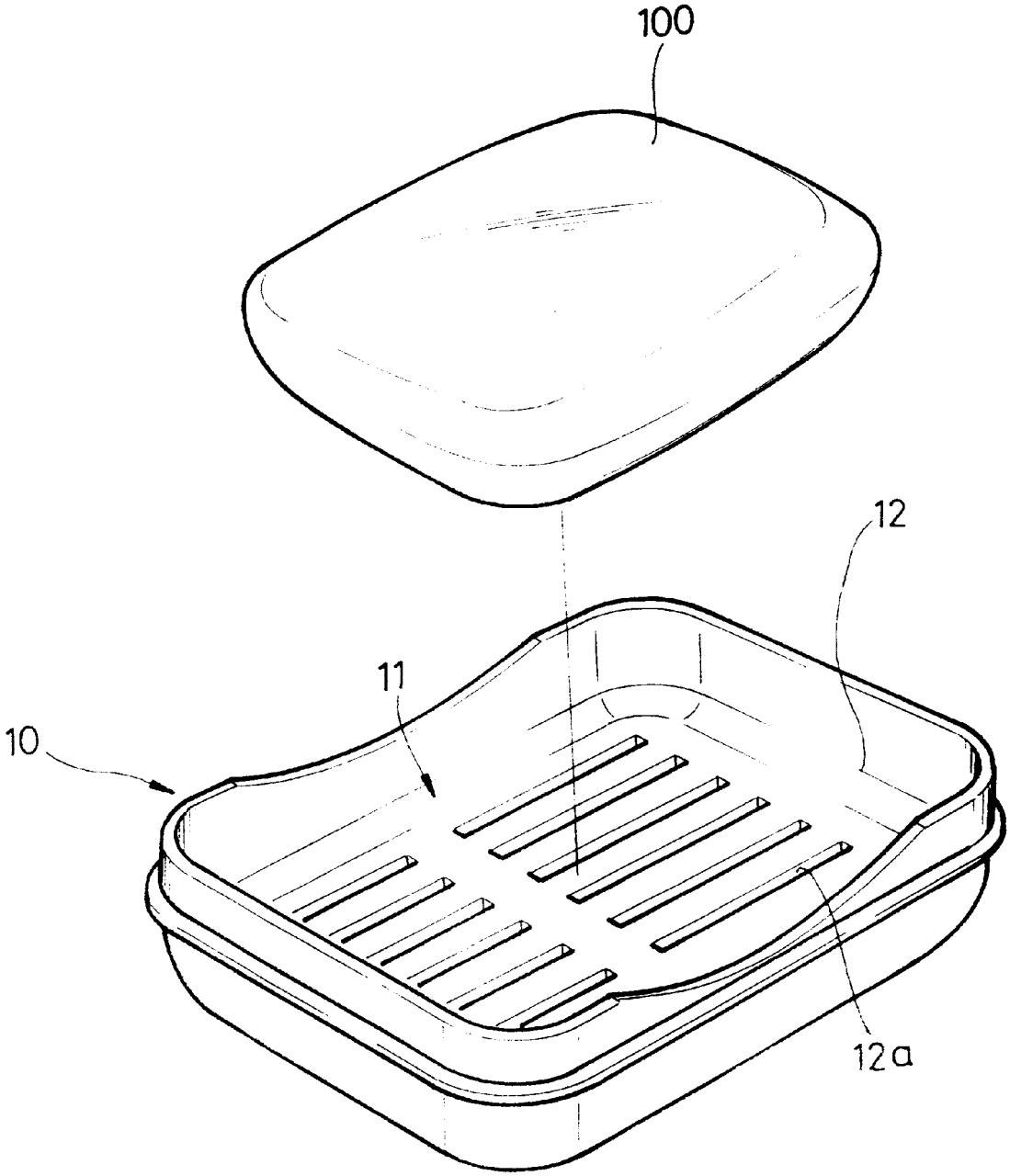
FIG. 1 (PRIOR ART)
FIG. 1 is a perspective view illustrating a typical soap case and a bar of soap to be put therein.
Figure 2:
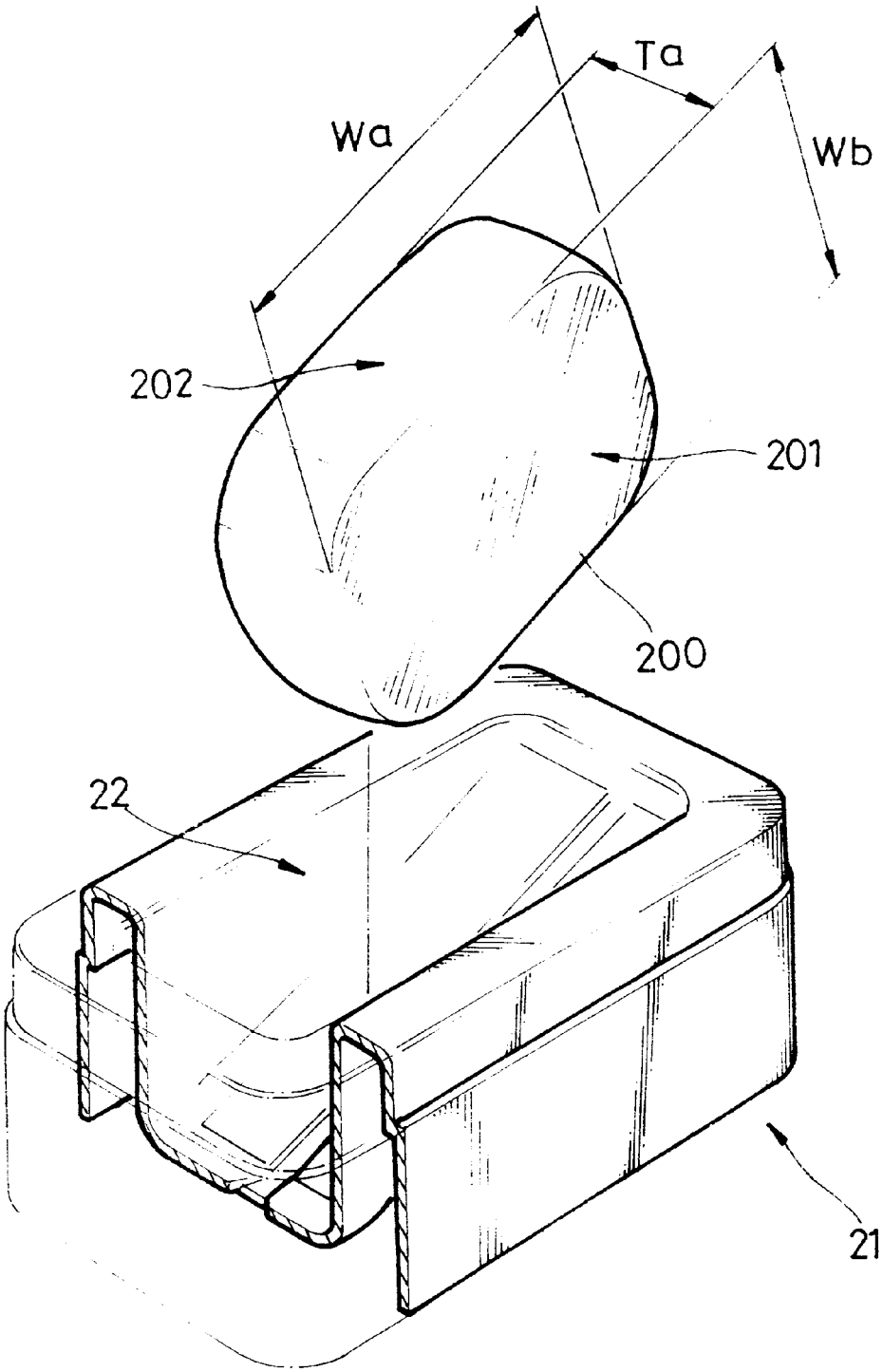
FIG. 2 (PRIOR ART)
FIG. 2 is a partially cut-away perspective view illustrating another conventional soap case according to conventional technology.
Figure 3:
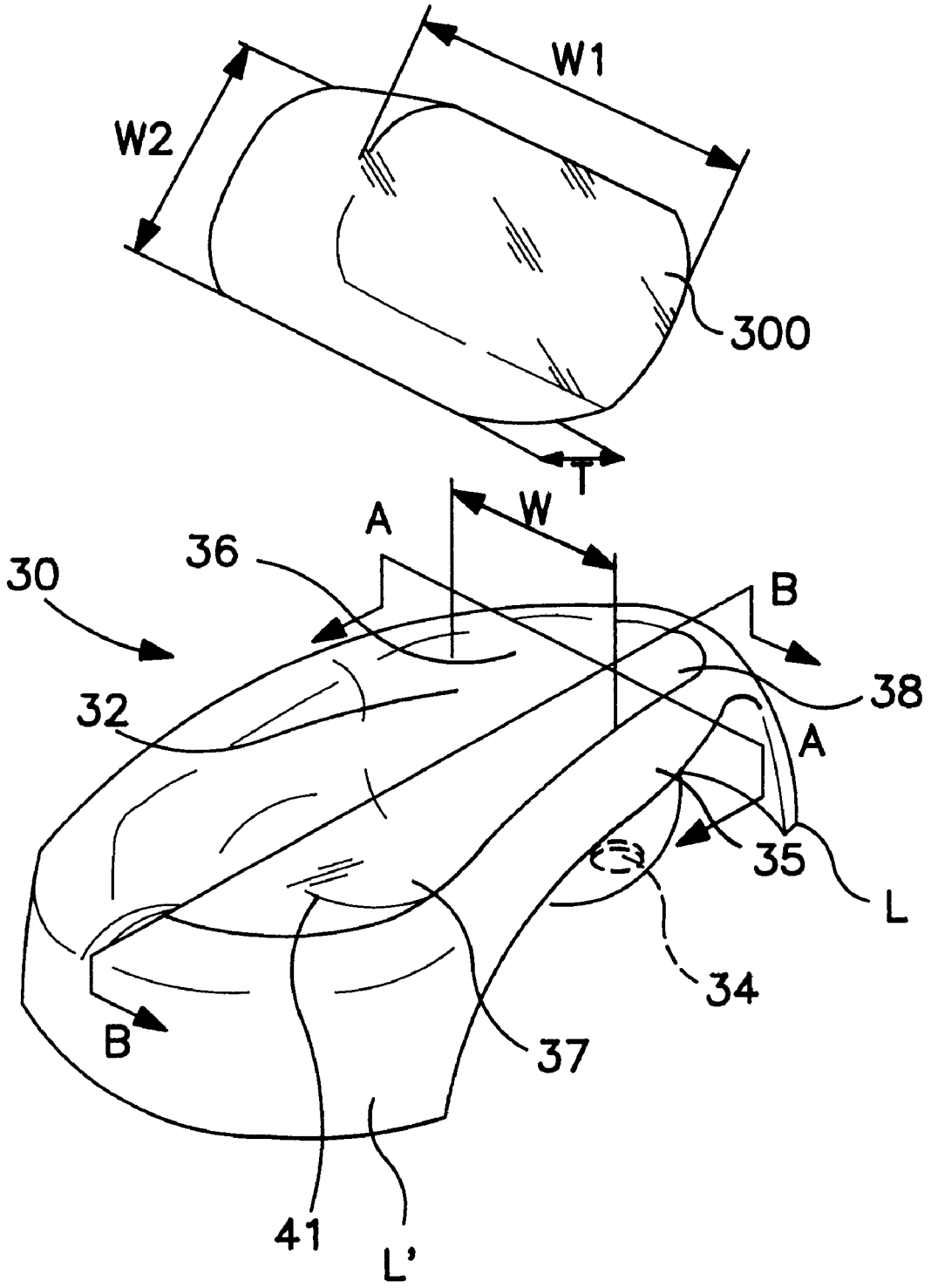
FIG. 3 is a perspective view illustrating an embodiment of a soap case according to the present invention.

As shown in FIG. 3, a receiving portion 32 of a soap case 30 is formed to have a predetermined varying width W and a varying depth. The receiving portion 32 of the case 30 has side surfaces 36, front surface 38, a rim surface 35 and a bottom surface 37 that are formed to be curved and rounded as a whole. The bottom surface 37 has a slope of a predetermined angle toward a front surface 38, i.e., in the direction of receiving the bar of soap 300. The soap case has a vertical axis, a horizontal axis, and a center line coextensive with the vertical axis. A curved ridge 41 is integral with the bottom surface 37 and disposed between a front end and a back end of the bottom surface. The curved ridge 41 is closer to one of the side surfaces 36 than the other, and generally extending from the center line of the soap case, over to a melting into one of the side surfaces. The curved ridge 41 facilitates a bar of soap received in the soap case contacting no more than two points on the bottom surface of the case. A water outlet hole 34 is provided at the lowermost portion of the receiving portion 32. The bar of soap 300, preferably cubic in shape, has a predetermined length W1, width W2 and thickness T. The width W of the receiving portion 32 is formed to be greater than the thickness T of the bar of soap 300 and less than the width W2 of the bar of soap so that the bar of soap can be received in a standing position. Also, the rim surface 35 of the receiving portion 32 is formed to be curved getting narrower toward the front surface 38, i.e., toward the direction of receiving the bar of soap together with the side surfaces 36. Both side surfaces 36 are curved so that the effective contact portions actually contacting the bar of soap as the bar of soap is received becoming narrower towards the bottom of the case, i.e., the side surfaces 36 are curved inwards. The front surface 38 supports the received bar of soap to stand in a stable position, and the rim surface 35 has a curved shape extending from the side surface 36. Also, the soap case 30 is provided with a support L formed by extending a portion of the soap case 30 for the stable placement thereof.

Hereinafter, the soap case according to the present invention will now be described in more detail with reference to the attached drawings.

Figure 4A:
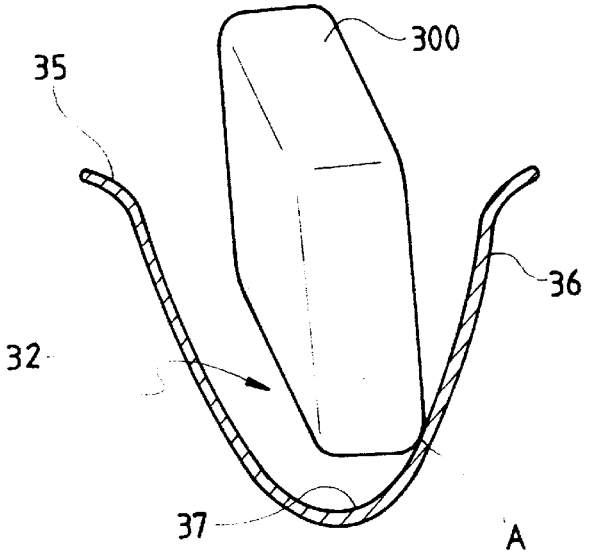
FIGS. 4A and 4B are vertical sectional views taken along line A—A and line B—B in FIG. 3, respectively, showing a state in which a bar of soap is received in the soap case of the present invention.
Figure 4B:
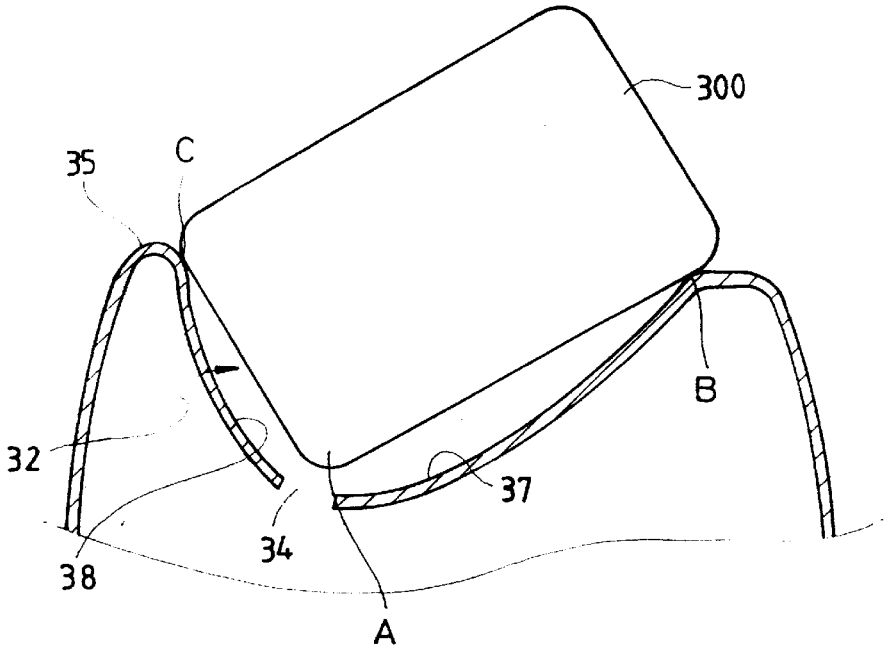

FIGS. 4A and 4B show vertical sectional views of the receiving portion 32 taken along lines A—A and B—B of FIG. 3, respectively, and the entire shape of the soap 300 is represented three-dimensionally. As shown in FIG. 4A, the side surfaces 36 of the receiving portion 32 are intentionally curved inwards, narrowing the receiving portion 32 as it goes down and makes point-contact with the bar of soap 300 at a point A. In FIG. 4B, the bottom surface 37 of the receiving portion 32 slopes downward at a predetermined angle toward the front surface 38, i.e., in a direction of receiving the bar of soap and makes point-contact with the bar of soap at a point B. Also, the bar of soap makes point-contact with the front surface 38 at a point C toward the water outlet hole 34. The position of the contact point A on the bar of soap 300 is also shown in the drawing.

In other words, in the present embodiment, the bar of soap makes point-contact with the receiving portion at three points and is supported by the three contact points. In the meantime, if the center of gravity of the soap is lower than the points B and C, the bar of soap can be supported by the two points B and C only, without contacting a side surface. That is, the soap can be supported by contacting the receiving portion at least two point points.

Next, the shape and operation of the surfaces 36 and 38 and the bottom surface 37 of the receiving portion 32 formed to be curved will be described while analyzing the state of the soap in the middle of being received in the receiving portion 32.

Figure 5:
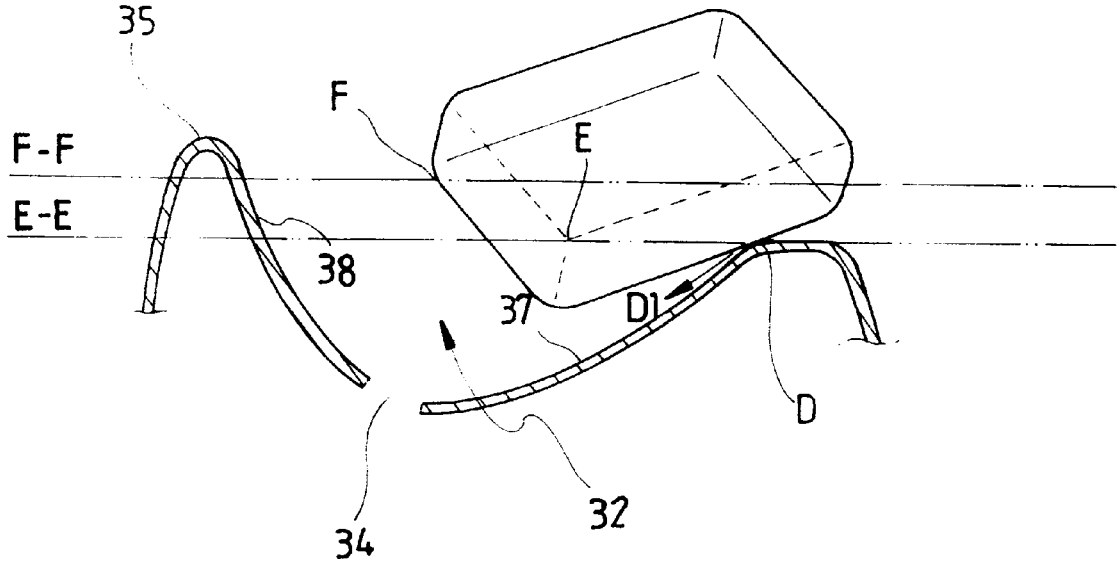
FIG. 5 is a vertical sectional view of a receiving portion showing a state in which the bar of soap is being received in the soap case shown in FIG. 3.

FIG. 5 shows a vertical sectional view of the receiving portion 32 at the point where the bar of soap being in the middle of being received therein contacts the bottom surface 37 of the receiving portion 32. In the drawing, the soap is illustrated three-dimensionally, the sections of the front surface 38 and the bottom surface 37 of the receiving portion 32 are shown, and the bottom surface is sloped at a predetermined angle downward toward the soap receiving direction. The three-dimensionally shaped soap 300 makes point-contact with the bottom surface 37 at a point D, and also makes point-contact with the side surfaces 36 of the receiving portion 32 at points E and F. It can be seen that the bar of soap 300 voluntarily slides in due to the weight of the soap 300 itself toward the front surface 38, i.e., in the direction indicated by arrow D1 which is the soap receiving direction. E—E represents a horizontal plane including contact point E and F—F represents a horizontal plane including contact point F.

Figure 6:
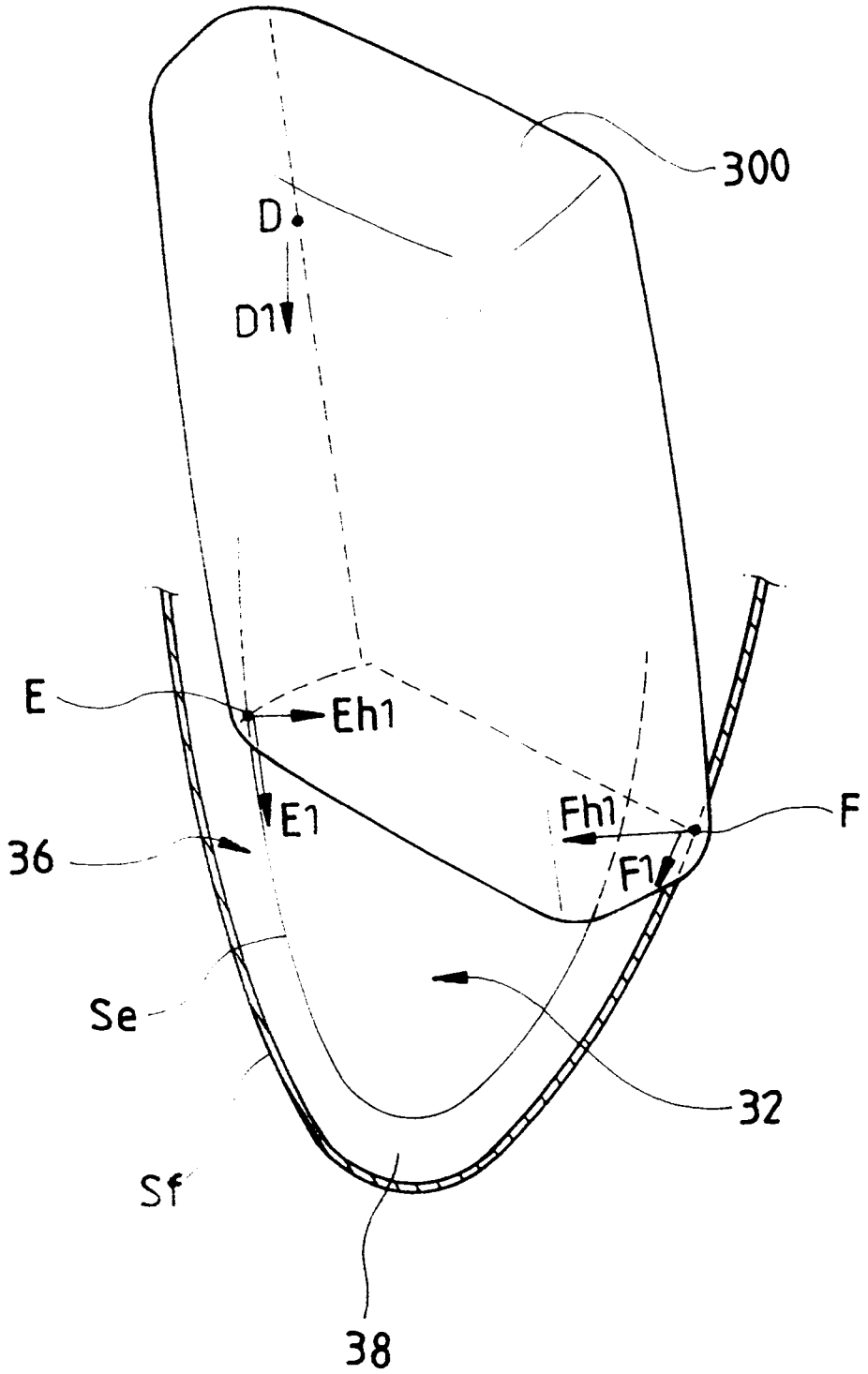
FIG. 6 is a sectional view of a portion of the side surface of the receiving portion showing a state in which the bar of soap is being received in the soap case shown in FIG. 3.

FIG. 6 is a cross sectional view of a portion of the side surfaces 36 and front surface 38 of the receiving portion 32 at the point (E and F) at which the bar of soap 300 in the middle of being received contacts the side surface 36 of the receiving portion 32. In the drawing, the bar of soap 300 is illustrated three-dimensionally. Here, Se is a cross section of a portion of the surfaces of the receiving portion 32 cut along plane E—E of FIG. 5, and Sf is a cross section of a portion of the surfaces of the receiving portion cut along plane F—F of FIG. 5. As in the description for the FIG. 3, the sections Se and Sf have a width W greater than thickness T and less than width W2 of the bar of soap 300, respectively. The distance between the side surfaces 36, i.e., the width W of the receiving portion 32 becomes narrower toward the front surface 38. The points E and F are contact points between the bar of soap 300 and the side surface 36 of the receiving portion 32. As shown in FIG. 5, since the bar of soap moves toward the front surface 38 of the receiving portion 32, the bar of soap slides in the direction indicated by arrow E1 at the point E and in the direction indicated by arrow F1 at the point F, respectively. At this time, the soap receives repelling forces from the side surfaces 36 in the direction indicated by arrow Eh1 at the point E and in the direction indicated by Fh1 at the point F, respectively. However, as shown in FIG. 5, since the point E is disposed quite lower than the point F, the bar of soap will voluntarily stand upright. The point D and the arrow D1 are the same as those in FIG. 5.

Figure 7:
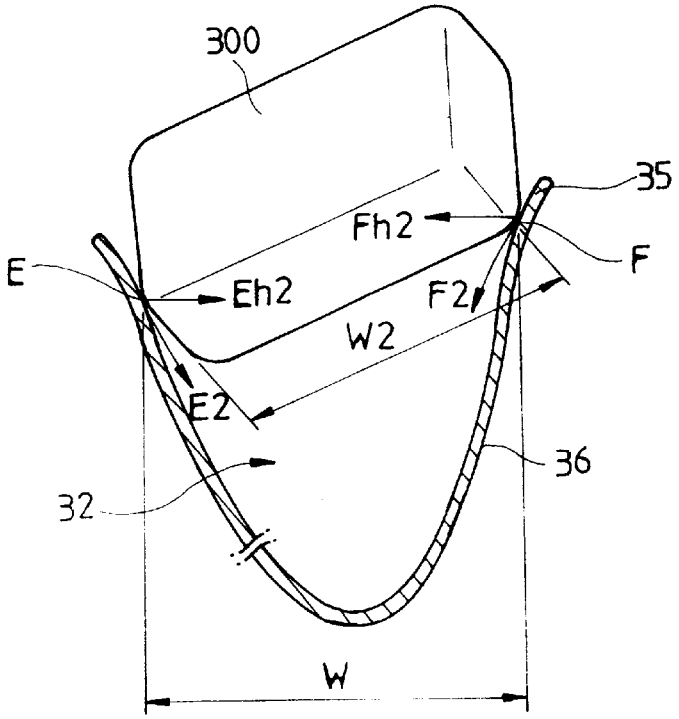
FIG. 7 is a vertical sectional view of a portion of the side surface of the receiving portion showing a state in which the bar of soap is being received in the soap case shown in FIG. 3.

FIG. 7 is a vertical sectional view of a portion of the side surfaces 36 of the receiving portion 32 at respective points E and F at which the bar of soap 300 in the middle of being received contacts the side surfaces 36 of the receiving portion 32.

The side surfaces 36 and the bottom surface 37 are joined as a continuous curved surface and formed to be narrower as towards the bottom. The bar of soap 300 is illustrated three-dimensionally and located at the same position as shown in FIGS. 5 and 6. The bar of soap 300 sliding in the direction indicated by arrow E2 at the point E and in the direction indicated by arrow F2 at the point F receives repelling forces in the direction indicated by arrow Eh2 and in the direction indicated by Fh2, respectively. Thus, the bar of soap 300 voluntarily stands upright.

In the meantime, since the receiving portion 32 has sufficient depth in the vicinity of front surface 38 as shown in FIG. 5, the bar of soap 300 received in the receiving portion 32 having a width narrower than the width of the bar of soap 300 can stand stably by both the side surfaces 36.

When the both side surfaces 36 or the rim surface 35 becomes narrower toward the front surface 38, i.e., the bar of soap receiving direction, as shown in FIG. 6, the width of the receiving portion 32 is further narrowed so that the bar of soap is supported to stand upright more stably. Accordingly, the bar of soap 300 can stand stably also in case the receiving portion is not deep enough, and further, even when the upper portion of the front surface 38 does not exist to some extent.

Also, even when the distance between the side surfaces 36 or the rim surfaces 35, which gets narrower toward the direction of receiving the bar of soap as shown in FIG. 6, does not get narrower, it is possible that the bar of soap 300 can voluntarily stand upright by the forces described in FIGS. 5 and 7. However, the forces described in FIG. 6 can more securely allow the bar of soap to voluntarily stand upright.

In the description of the intentionally curved surfaces, the entire portion of the side surfaces or the rim surface does not necessarily have to narrow as it goes down or in the bar of soap receiving direction. It is sufficient that only the effective portion in contact with the bar of soap gets narrower for the bar of soap to voluntarily stand upright.

In the above embodiment described with reference to FIGS. 4A–4B, 5, 6, and 7, a bar of soap is received voluntarily in a standing position and when the receiving is complete, the bar of soap remains stably upright while making point-contact with surfaces of the soap case.

Hereinafter, the concept of the width W of the receiving portion 32 described above will be described in more detail referring to FIG. 8.

Figure 8:
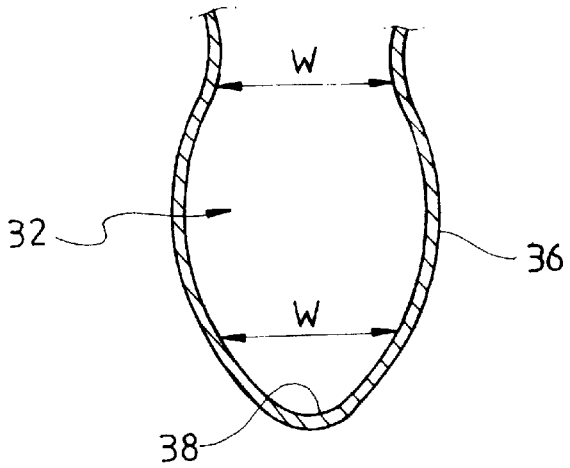
FIG. 8 is a sectional view of a portion of the receiving portion for explaining the concept of the width of the receiving portion.

FIG. 8 is a cross sectional view showing a portion of the receiving portion for explaining the concept of the width W of the receiving portion 32. In the drawing, the soap case includes a portion in which the distance between the side surfaces 36 is a distance W apart and a portion in which the distance therebetween is greater than W. Here, the effective portion of the side surfaces in receiving the bar of soap 300 in a standing position is the portion in which the distance between the side surfaces is W. That is, in the description of the present invention, the width of the receiving portion for receiving the bar of soap in a standing position represents the width W of the receiving portion at the side surface portion effective in keeping bar of soap upright.

In the meantime, rather than the shapes shown in the above-described embodiment, there can be a variety of shapes for the side surfaces, the rim surface and the bottom surface formed of intentional curved surface for guiding a bar of soap which is voluntarily received in a standing position supporting the received bar of soap to stably stand upright and allowing the bar of soap to make point-contact with the receiving portion. The examples are shown in FIGS. 9, 10 and 11 in which the bar of soap is illustrated three dimensionally.

Figure 9:
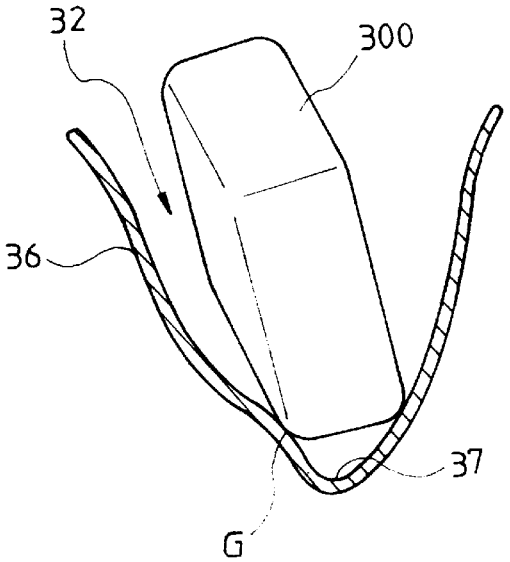
FIG. 9 is a vertical sectional view of a receiving portion for preventing water droplets from being formed at an edge of a soap in a soap case according to the present invention.

FIG. 9 is a vertical sectional view of a receiving portion by which no water drops are formed at the end portion of the bar of soap. The shapes of the side surfaces 36 and the bottom surface 37 are been modified version of the above -described embodiment. The water flowing down the body of the bar of soap is not formed as a water drop at an end portion G of the bar of soap but flows down along the modified side surface or bottom surface.

Figure 10:
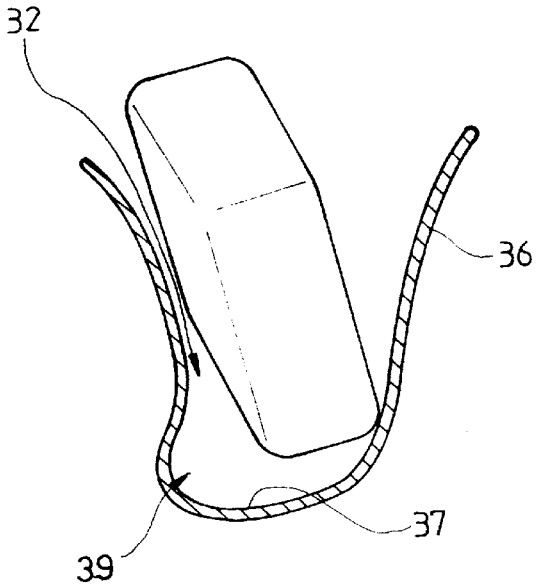
FIG. 10 is a vertical sectional view of a receiving portion having an air flow pocket formed in a soap case according to the present invention.

FIG. 10 is a vertical sectional view of a receiving portion in which an air flow pocket 39 is formed by modifying one side surface 36 and the bottom surface 37 of the above-described embodiment. The air flowing in through the water outlet hole 34 shown in FIG. 4B is ventilated via the air flow pocket 39.

Figure 11:
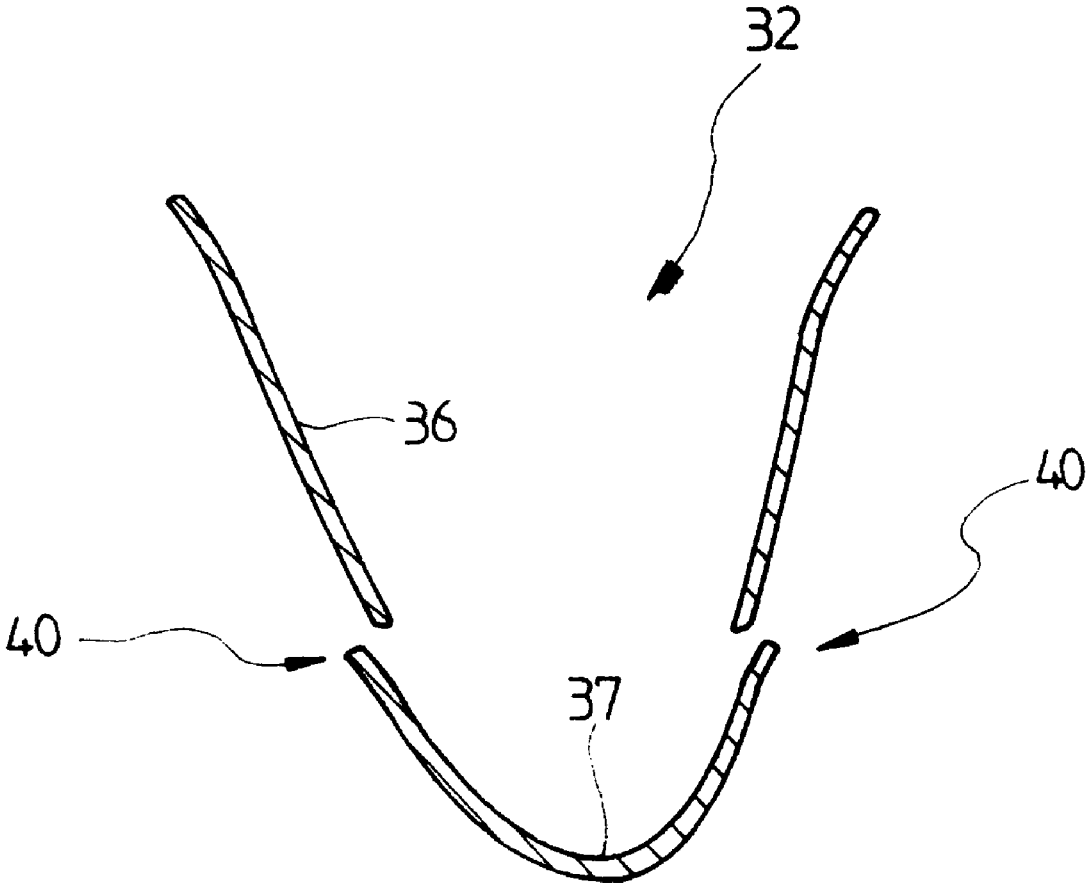
FIG. 11 is a vertical sectional view of a receiving portion having an air hole formed at the side surfaces in a soap case according to the present invention.

FIG. 11 is a vertical sectional view of a receiving portion having at least one opening 40 for allowing air to ventilate inside a receiving portion 32. The opening 40 is formed in the side surface 36 without hindering the bar of soap from voluntarily sliding down. Such an opening can be formed in the bottom surface 37 of the receiving portion 32 shown in FIG. 4A.

As described above, although there can be numerous modifications to the soap case, it is a characteristic feature of the present invention in that an effective curved surface for guiding or receiving the bar of soap to voluntarily stand upright and allowing the received bar of soap to make a point contact with the soap case, is provided at the effective contact portions on the side surface, the rim surface and the bottom surface which actually contact the bar of soap being received. Thus, the shapes of the other portions can be modified differently from the above embodiments in view of various design concepts.

Figure 12:
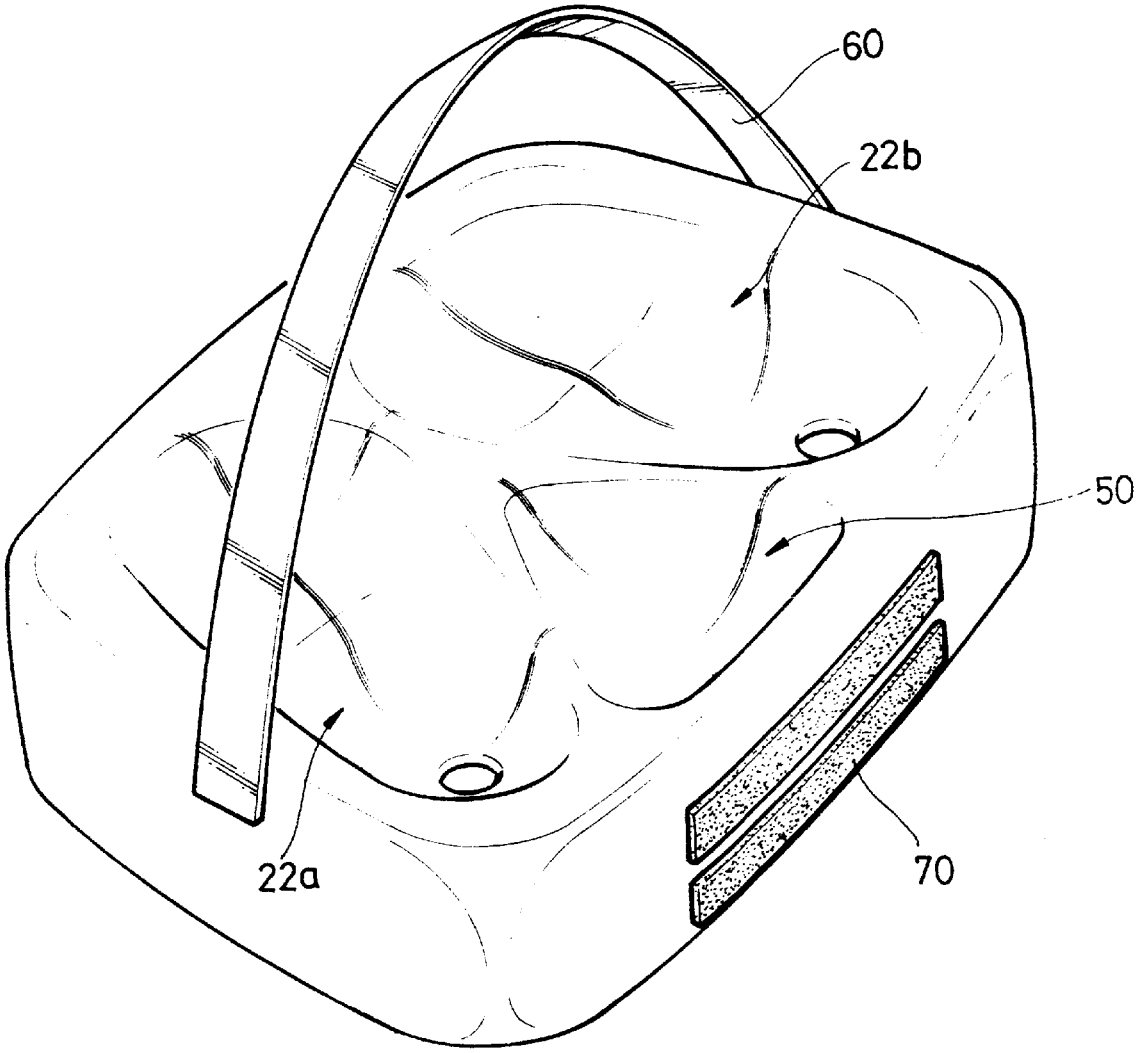
FIG. 12 is a perspective view for showing modifications made to the present invention.

It is obvious that various modifications and alterations to the soap case can be made. As shown in FIG. 12, a plurality of receiving portions 22*a* and 22*b* can be formed in one soap case. That is, the receiving portions can be arranged to allow the front surface 38 to face each other or the side surfaces to be in parallel with each other. Here, when rim surfaces of each of the receiving portions are connected by a smooth curved surface, the bar of soap placed on the receiving portion in an arbitrary direction can be easily received in any one of the receiving portions. Further, a lid (not shown) or a handle 60 can be provided in the soap case, and a means 70 for attaching the receiving portion to the wall and an auxiliary container 50 for storing contact lens or bathing items can also be provided.

The operation of the soap case having such a structure according to the present invention will now be described.

Since the soap case 30 formed such that the width W of the receiving portion 32 is formed to be wider than the thickness T of the bar of soap 300 and narrower than the width W2 of the bar of soap and the bottom surface 37 is sloped at a predetermined angle, the bar of soap is received to stand upright such that the length W1 is angled at a predetermined degree. Thus, the water on all surfaces of the bar of soap rapidly flows down. The side surfaces 36, front surface 38, rim surface 35 and bottom surfaces 37 of the receiving portion 32 have an intentional and calculated curved surface to receive the bar of soap to voluntarily stand upright so that the bar of soap is received by sliding and standing upright voluntarily even if the bar of soap is not carefully placed in the soap case. The received bar of soap remains standing upright by making point-contact with the side surfaces 36, front surface 38 and bottom surface 37 or the rim surface 35 of the receiving portion 32.

As described above, the soap case according to the present invention has the following advantages: 1) the water left on the surface of the bar of soap rapidly flows down so that the bar of soap dries quickly; 2) the bar of soap is received as voluntarily standing upright, which facilitates the receiving by making the bar of soap stand upright even when being placed aslant; and 3) since the bar of soap makes point-contact with the surfaces of the soap case, the bar of soap does not soften and dries quickly due to the smooth ventilation of air around the bar of soap.

What is claimed is:

1. A soap case having a vertical and horizontal axis, a center line coextensive with said vertical axis, a top, and a bottom, comprising:

a front wall having a front surface;

a pair of generally opposed side walls each having a respective side surface;

a bottom wall having a front end, back end and bottom surface;

a curved ridge integral with said bottom wall; and a support wall having a top and bottom integrally connected to and supporting said back end of said bottom wall;

said front, opposed side and bottom walls integrally connected and defining an open receiving portion, said front and side walls each having a respective and corresponding top and bottom, wherein all of said bottoms are integral with said bottom wall, each of said side walls sloping inwardly toward the open receiving area and the vertical axis of said case, said front end of said bottom wall narrower with respect to said back end and diverging outwardly toward said back end, with said back end being arcuately configured, said curved ridge of said bottom wall disposed between said front end and said back end, closer to one of said side walls than the other, said curved ridge generally extending from the centerline, over to and melting into one of said side walls;

whereby said configuration of said case in conjunction with said curved ridge, facilitates contacting a bar of soap received in said case, only at one point on each of only two of said front or side wall surfaces, and no more than two points on said bottom wall surface of said receiving portion.

2. A soap case according to claim 1 further comprising a rim having a curved top surface surrounding said receiving portion, said rim is integral with the tops of said front, support, and side walls.

3. A soap case as claimed in claim 1, wherein a plurality of said receiving portions are formed in one soap case.

4. A soap case according to claim 1, further comprising a means for attaching said soap case to a wall.

5. A soap case according to claim 1, further comprising an auxiliary container for storing contact lenses or bathing items integral with said receiving portion of said soap case.

6. A soap case according to claim 1, further comprising a gripping means for transferring said soap case.

7. A soap case according to claim 1, further comprising a supporting portion integral with said soap case for stably securing said soap case to a fixed structure.

8. A soap case according to claim 1, wherein a portion of at least one of said side walls, said front wall or said bottom wall is removed to facilitate the drainage of water and the ventilation of air.

9. A soap case having a vertical and horizontal axis and containing a bar of soap having a width, a thickness, and defining a standing upright position when said bar of soap is received in said case with the thickness of said bar generally parallel to the vertical axis of said case, comprising:

a front wall having a front surface;

two generally opposed side walls each having respective top and bottom ends and respective side surfaces;

a bottom wall having a bottom surface, a front portion, a rear portion, and a width, wherein the width of said bottom wall at said rear portion is greater than the width of said bottom wall at said front portion, a surrounding rim; and a supporting wall, said front, opposed side, and bottom walls integrally connected and defining a receiving portion for receiving said bar of soap, said receiving portion delimited by said surrounding rim, said receiving portion having a width and a depth relative to said surrounding rim, the width of said receiving portion near said front wall is wider than the thickness of said bar of soap but narrower than the width of said bar of soap, the depth of said receiving portion near said front wall is deeper than said receiving portion at an end opposite said front wall, wherein said bar of soap is received in a standing upright position in said receiving portion, with said front wall supporting said bar of soap, said bottom wall sloping toward said front wall, said front wall and said generally opposed side walls each having a respective top end and bottom end, wherein said bottom ends of said side walls form exacting curved surfaces, and said sidewalls curve toward each other and melt with said bottom and front walls, said surrounding rim connects with the tops of said generally opposed side walls and said front wall, and connects with the rear portion of said bottom wall, said supporting wall connects to said surrounding rim at the rear portion of said bottom wall, whereby said collective configuration of said side walls, said front wall, said bottom wall, and said surrounding rim facilitate said bar of soap received in said receiving portion making only point contact with each of said respective walls and said surrounding rim.

10. A soap case as claimed in claim 9, wherein a portion of one of said generally opposed side walls and a portion of said front wall, and bottom wall, is removed to facilitate drainage of water from said case and ventilate air into said case.

* * * * *